US005235325A

United States Patent [19]

McCaughan, Jr.

[11] Patent Number: 5,235,325

[45] Date of Patent: Aug. 10, 1993

[54] WEIGHT ALARM DEVICE FOR TRASH CONTAINERS

[76] Inventor: James L. McCaughan, Jr., 17615 Cypress Spring, Spring, Tex. 77388

[21] Appl. No.: 835,828

[22] Filed: Feb. 18, 1992

[51] Int. Cl.[5] ..... G08B 21/00; H01H 3/02

[52] U.S. Cl. ..... 340/666; 200/85 R; 340/693

[58] Field of Search ..... 340/666, 693, 568; 200/85 R; 177/45, 132, 245

[56] References Cited

U.S. PATENT DOCUMENTS

| | | | |
|---|---|---|---|
| 2,045,496 | 6/1936 | Skinner | 340/666 X |
| 2,300,705 | 11/1942 | Schott | 340/666 X |
| 2,836,672 | 5/1958 | Craven, Jr. et al. | 200/85 |
| 2,879,708 | 3/1959 | Cripe | 99/342 |
| 3,082,832 | 3/1963 | Mitthauer et al. | 177/117 |
| 3,259,894 | 7/1966 | Ciccarone | 340/272 |
| 3,559,204 | 1/1971 | Dashper | 340/272 |
| 3,703,715 | 11/1972 | McNally | 340/240 |
| 3,778,808 | 12/1973 | Stevens | 340/282 |
| 4,102,262 | 7/1978 | Liberman et al. | 177/45 X |
| 4,188,622 | 2/1980 | Miller et al. | 340/571 |
| 4,274,088 | 6/1981 | Pierson et al. | 340/568 |
| 4,437,090 | 3/1984 | Hanson | 340/666 X |
| 4,531,116 | 7/1985 | Takagi et al. | 340/666 X |
| 4,657,095 | 4/1987 | Hardin, Jr. et al. | 177/132 |
| 4,716,401 | 12/1987 | Wohlford et al. | 340/666 X |

FOREIGN PATENT DOCUMENTS

| | | | |
|---|---|---|---|
| 0063217 | 5/1981 | Japan | 177/45 |
| 1420380 | 8/1988 | U.S.S.R. | 177/45 |

*Primary Examiner*—Thomas J. Mullen, Jr.
*Attorney, Agent, or Firm*—Harrison & Egbert

[57] ABSTRACT

A weight alarm device for a trash container having a body with a top surface resiliently connected to a bottom surface, a switch attached to the body and responsive to relative movement between the top surface and the bottom surface, and an alarm electrically connected to the switch for producing a humanly perceivable signal when the relative movement between the top surface and the bottom surface exceeds a predetermined amount. The body has a shape adapted for receipt within the trash container. The top surface and the bottom surface have overlapping sides extending around the periphery of the surfaces. A coil spring is interposed between the top and bottom surfaces. The switch is a contact switch which is movable between a first position and an alarm sounding second position. An abutment member is connected to the bottom surface so as to contact the contact switch upon a movement of the top surface beyond a predetermined amount.

18 Claims, 3 Drawing Sheets

WEIGHT ALARM DEVICE FOR TRASH CONTAINERS

TECHNICAL FIELD

The present invention relates to weight alarm devices in general. More particularly, the present invention relates to alarm devices that are adapted for use in trash containers.

BACKGROUND ART

The building maintenance industry is a highly labor-intensive business. Companies that are contracted to clean and maintain buildings are subject to a wide variety of requirements by the contractor and subject to numerous regulations by the Occupational Safety and Health Act. Often, the workers employed by such building maintenance companies can have physical problems which makes it difficult to lift heavy loads.

During normal building maintenance activities, it is very difficult to know the weight of material within a trash container until the liner bag has been lifted. If the liner bag is excessively heavy, then an injury can occur to the body of the worker before the worker realizes how much weight is actually in the bag. Injuries to the building maintenance workers cause a great deal of difficulty to the maintenance companies. Normally, workmen's compensation claims are filed, hospitalization may be required, and labor time is lost. As such, it is very desirable to avoid a situation in which the workers are subjected to potential injury from the lifting of heavy loads.

It is often difficult for persons that use trash containers to know exactly the amount of weight that has been placed in the container. Often, trash containers are used by a large number of people. As such, even if the person using the trash container were concerned about the well being of the building maintenance employee, it would be difficult to control the amount of material that was received by the liner of the trash container. Normally, trash containers within buildings provide no feedback to the user as to the amount of weight contained in the container.

In the past, various U.S. patents have issued with respect to weight-responsive alarm devices. U.S. Pat. No. 3,559,204, issued on Jan. 26, 1971, to W. Dashber teaches an alarm system for a laundry sling truck that is activated when a certain level of weight is received. In this device, an audio alarm is sounded when the linen deposited in a sling reaches a predesignated weight. The intended purpose of this device is to sound an alarm so as to maximize the capability of filling laundry bags. U.S. Pat. No. 2,836,672, issued on May 27, 1958, to Craven et al. provides a safety device for a waste tank. A signal is sounded when the waste tank of a vending machine is filled with liquids. U.S. Pat. No. 2,879,708, issued on Mar. 31, 1959, to G. H. Cripe provides a weight-activated alarm which is connected to a grease accumulator for a kitchen stove. A signal is produced when grease has been accumulated beyond a desired amount. U.S. Pat. No. 3,082,832, issued on Mar. 26, 1963, to Mitthauer et al. shows a weight-responsive switch which is activated when liquid in a container exceeds a predetermined limit. U.S. Pat. No. 3,703,715, issued on Nov. 21, 1972, to B. L. McNally discloses an alarm for indicating a sudden flow of fluid into or out of a drain. U.S. Pat. No. 3,259,894, issued on Jul. 5, 1966 to A. E. Ciccarone provides a snow alarm which produces a signal when an excessive amount of snow has fallen within a desired area. The alarm is responsive to the accumulation of snow.

One patent has issued in the past which is specifically related to alarms for waste containers. U.S. Pat. No. 4,188,622, issued on Feb. 12, 1980, to Miller et al. utilizes a strap assembly constructed of a deformable and resilient dielectric material. The strap is adapted so as to extend around the exterior of an upright trash can. This alarm device is specifically configured so as to be indicative of when a trash receptacle is being tampered with by a dog or other animal. It is not designed so as to provide an alarm when an excessive weight is applied to a liner within the trash can.

Additionally, a weight monitor is described in U.S. Pat. No. 3,778,808, issued on Dec. 11, 1973, to G. S. Stevens. This device utilizes a top surface, a bottom surface, and a pair of resilient springs within the monitor so as to regulate the movement of the surfaces. A load cell is provided for determining the amount of weight placed on the top surface. No alarm is provided for notifying others of an application of excessive weight.

It is an object of the present invention to provide a weight-activated alarm that is adapted for use within a trash container.

It is another object of the present invention to provide a weight-activated alarm which has a relatively broad surface area for receiving wide and uneven loads.

It is another object of the present invention to provide a weight-activated alarm which is generally liquid resistant.

It is another object of the present invention to provide a weight-activated alarm which is easy to use, simple to manufacture, and relatively inexpensive.

These and other objects and advantages of the present invention will become apparent from a reading of the attached specification and appended claims.

SUMMARY OF THE INVENTION

The present invention is a weight alarm device responsive to a weight of material in a trash liner within a trash container comprising a body having a top surface resiliently connected to a bottom surface, a switch attached to the body so as to be responsive to relative movement between the top surface and the bottom surface, and an alarm electrically connected to the switch. The body has a shape which is adapted for receipt by the trash container. In particular, the body has a configuration that can be placed onto or against the bottom of a trash container. The alarm produces a humanly perceivable signal when the relative movement between the top surface and the bottom surface exceeds a predetermined amount.

The top surface has a first side extending downwardly therefrom. The bottom surface has a second side extending upwardly therefrom. The first side of the top surface overlaps the second side of the bottom surface. The first side extends around a periphery of the top surface. The second side extends around a periphery of the bottom surface. The bottom surface has a plurality of feet formed thereon. These feet extend below the bottom surface so as to abut an internal bottom of the trash container. The top surface and the bottom surface have a circular shape and the sides have a generally cylindrical configuration. The side associated with the bottom surface is slidably received within the side of the top surface.

The top surface has an indentation formed therein. This indentation receives the alarm and provides a surface onto which the switch can be attached. The present invention further includes a power supply, such as a battery, which is electrically connected to the alarm. The power supply serves to supply power to the alarm when the alarm is actuated by the switch. The alarm is generally an audio alarm. However, in keeping with the present invention, the alarm could also be a visual alarm. The indentation receives the power supply therein. A cover is removably fastened to the top surface over the indentation. This cover forms a liquid-seal with the top surface.

The body has a coil spring interposed between the top surface and the bottom surface. This coil spring provides a desired resistance to the relative movement between the top surface and the bottom surface. Specifically, a single coil spring is interposed between the top surface and the bottom surface within the body. This coil spring has one end affixed centrally to the bottom surface and an opposite end affixed centrally to the top surface. The coil spring has a diameter of greater than six inches.

The switch of the present invention comprises a contact switch which is interconnected to the top surface. This contact switch is movable between a first position and a second position. The second position serves to actuate the alarm. The switch also includes an abutment member which is interconnected to the bottom surface. The abutment member is aligned with the contact switch such that a predetermined relative movement of the top surface with respect to the bottom surface causes the abutment member to come into contact with the contact switch. The abutment member, upon contact, causes the contact switch to move from the first position to the alarm-actuating second position. The abutment member and the contact switch are positioned generally centrally within the coil spring.

As used, the alarm device of the present invention is placed at the bottom of a trash container. The body of the alarm device has a size which corresponds to the diameter of the trash container. A liner bag is placed within the trash container so as to extend within the trash container. The bottom of the liner bag will contact the top surface of the body. As material is added to the liner bag, the top surface of the body will generally compress toward the bottom surface. When the movement of the top surface exceeds a predetermined amount, the switch will be actuated so as to activate the alarm.

DETAILED DESCRIPTION OF THE INVENTION

Figure 1:
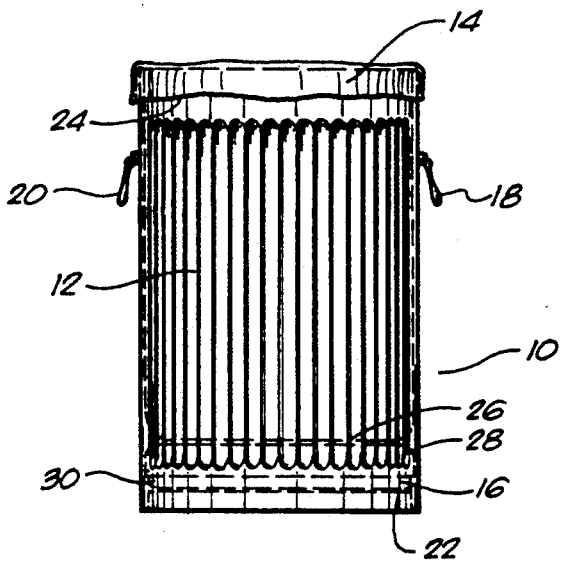
FIG. 1 is a side elevational view of a trash container showing, in particular, the alarm device of the present invention as positioned therewithin.

Referring to FIG. 1, there is shown at 10 the alarm device in accordance with the present invention. Alarm device 10 comprises a trash container 12, a liner bag 14, and a weight-activated alarm body 16. The alarm body 16 is illustrated in dotted line fashion.

Initially, in FIG. 1, it can be seen that the trash container 12 is a conventional trash can or other waste receptacle. Handles 18 and 20 extend outwardly from opposite sides of the trash container 12 so as to allow ease of lifting and emptying. Typically, the trash container 12 will have a generally cylindrical configuration with a sealed bottom 22. The trash container 12 may also be of a rectangular or square configuration. The trash container 12 opens at the top so as to allow for the introduction of materials into the interior of the trash container 12. It should be noted that the trash container 12 can be made of plastic, steel, or other materials. Although FIG. 1 shows a conventional stationary trash container, the present invention can be used with portable containers or containers supports on casters and wheels. The only requirement for the trash container of the present invention is that it provide a suitable receptacle for waste materials.

The liner bag 14 extends within the trash container. Liner bag 14 has an upper edge 24 which extends out of the trash container 12 and allows the bag 14 to be folded over the top edge of the trash container 12. The remaining portion of the liner bag 14 extends downwardly into the trash container 12 so as to form a receptacle area. The bottom 26 of liner bag 14 is positioned adjacent to the top surface 28 of the body of alarm body 16. The liner bag can be a conventional polyethylene trash bag which is disposable and removable.

The weight-activated alarm body 16 is positioned so that bottom surface 30 rests in juxtaposition with the bottom 22 of trash container 12. The diameter of the alarm body 16 should correspond with the inner diameter of the trash container 12. The top surface 28 is positioned adjacent to the bottom of the liner bag 14 and reacts to any weight placed into the liner bag 14. In the intended use of the present invention, the top surface 28 will gradually compress toward the bottom surface 30 as material is added to the liner bag 14. After a predetermined amount of weight has been added to liner bag 14, the top surface 28 will be compressed sufficiently so as to cause the sounding of an alarm within the alarm body 16. The alarm body 16 is described in the following drawings.

Figure 2:
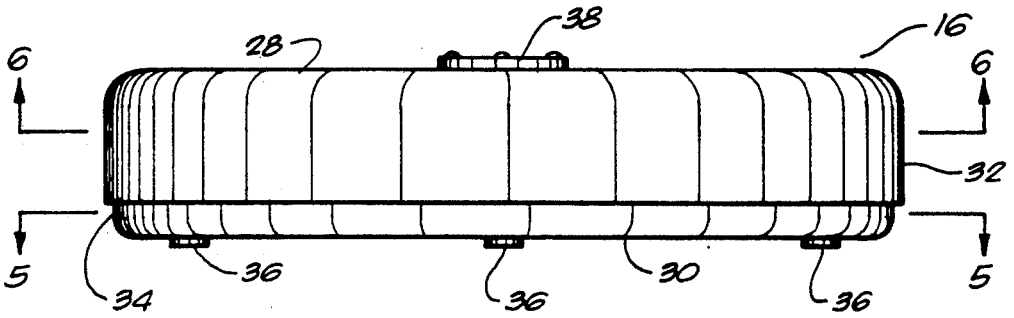
FIG. 2 is a side elevational view of the alarm device in accordance with the present invention.

FIG. 2 shows the weight-activated alarm body 16 as isolated from the trash container 12. The alarm body 16 has a top surface 28 which is resiliently connected to the bottom surface 30. It can be seen that the top surface 28 is relatively flat. Side 32 extends downwardly from the top surface 28. As will be described hereinafter, the top surface 28 is generally circular in configuration. The side 32 has a somewhat cylindrical shape. In the preferred embodiment of the present invention, the side 32 is integrally formed with top surface 28. However, and alternatively, the side 32 can be fastened to the outer periphery of the top surface 28. The top surface 28 and the side 32 form a liquid-resistant enclosure over the interior of the alarm body 16.

The bottom surface 30 includes a side 34 which extends upwardly from the outer periphery of bottom surface 30. Side 34 extends upwardly so as to be overlapped by the side 32 of the top surface 28 of body 16. As will be described hereinafter, the bottom surface is generally circular in nature. The side 34 is cylindrical. The side 34 is integrally formed with the bottom surface 30. So as to assure a proper fit of the top surface 28 with the bottom surface 30, the side 32 slides over the exterior of side 34 in a somewhat tight relationship. In general, the cooperation of the side 32 with the side 34 hinders water and other waste material from entering the interior of body 16.

It can be seen that the bottom surface 30 is generally flat so as to be positioned against the bottom 22 of waste container 12. The bottom surface 30 includes a plurality of feet 36 which extend below the bottom surface 30. Feet 36 are designed so as to prevent the sliding of the bottom surface 30 across the bottom 22 of trash container 12. As such, the feet 36 can include a frictional material which tends to prevent skidding.

A cover 38 is fastened to the top surface 28. Cover 38 resides in fairly close proximity to the top surface 28. The cover 38 is designed to cover an indentation formed within the top surface 28. Cover 38 seals the alarm and switching mechanism of the present invention from the intrusion of water and other materials.

Figure 3:
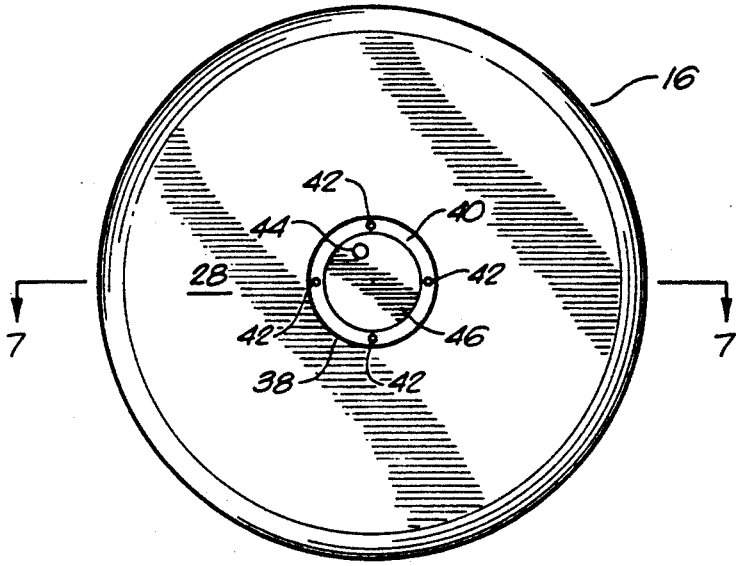
FIG. 3 is a top plan view of the alarm device of the present invention.

FIG. 3 is a top view of the top surface 28 of the body 16 of the present invention. As can be seen in FIG. 3, the top surface 28 is generally circular in nature. Although the present invention specifies a circular top surface 28, it should be kept in mind that the configuration of the top surface 28 can take on a wide variety of configurations. It is desirable that the top surface 28 have a configuration generally matching the internal configuration of the trash container 12. The cover 38 is positioned centrally on the top surface 28. Cover 38 overlies an indentation formed within the top surface 28. It can be seen that cover 38 is generally circular in nature and includes an overlap section 40 and a plurality of fasteners 42. Fasteners 42 serve to removably fasten the cover 38 to the top surface 28 of body 16. An opening 44 is formed in cover 38 so as to allow for the emission of sound from the alarm contained within the indentation below cover 38. The central area 46 of cover 38 may have a slightly domed surface. By using a domed cover 48, any liquid draining onto cover 38 will have the tendency to pass therefrom. Since the top surface 28 will be exposed to leakage, drainage, and waste material intrusion, it is important to appropriately isolate the electronics of the top cover from the elements to which it is exposed. As such, it is desirable that top cover 38 be in generally liquid-tight connection with the top surface 28.

Figure 4:
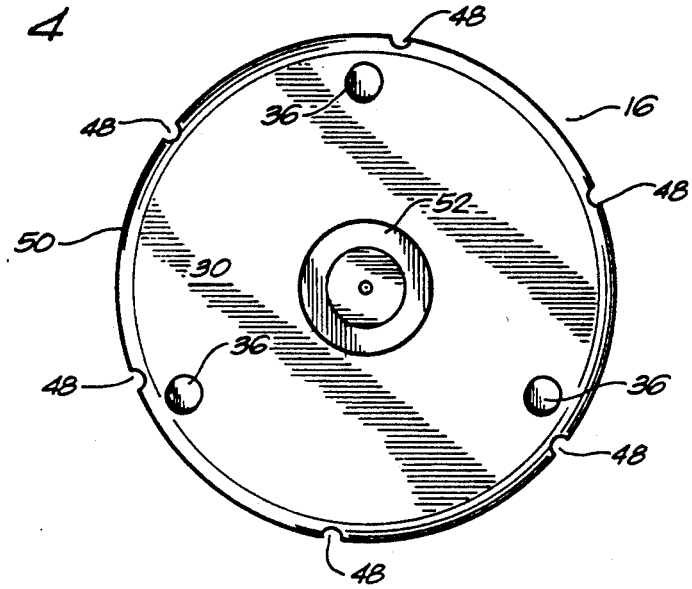
FIG. 4 is a bottom view showing the bottom surface of the alarm device of the present invention.

FIG. 4 is a bottom view of the body 16. Initially, it can be seen that the bottom 30 has a generally circular configuration corresponding to the circular configuration of the top surface 28. The bottom surface 30 includes a plurality of small indentations 48 extending around the outer periphery 50 of bottom surface 30. Since the side 34 is in close juxtaposition with and in sliding relationship with the inner wall of the side 32 of the top surface 28, it is necessary to allow air to escape from the interior of body 16. After experimentation, it has been found that if no means are provided so as to allow air to escape from the interior of body 16, then the contained air will tend to restrict or prevent the desired compressibility of the top surface 28 with respect to the bottom surface 30. The indentations 48 were formed so as to allow air to escape from the interior.

In FIG. 4, it can be seen that three feet 36 are evenly spaced around bottom surface 30. The feet 36 are generally circular. Feet 36 can be adhesively fastened to the bottom surface 30, can be mechanically fastened, or can be integrally formed in the molding process of the bottom surface 30. An anti-skid material can be fastened to the feet 36, if desired. Central area 52 is molded into the bottom surface 32. Central area 52 extends inwardly from the bottom surface 30. In general, the central area 52 supports an abutment member within the interior of body 16.

Figure 5:
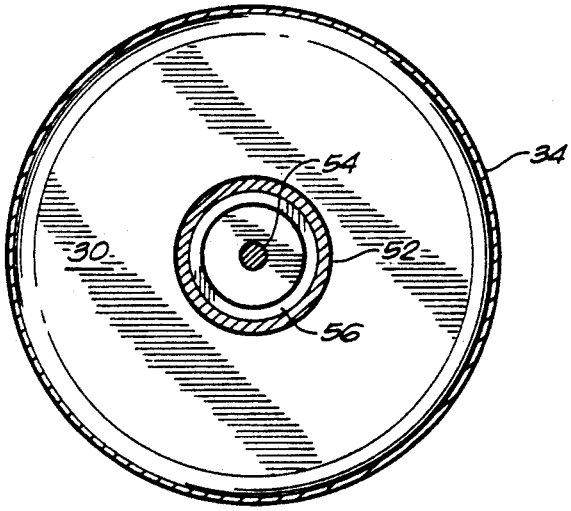
FIG. 5 is a cross-sectional view taken across lines 5—5 of FIG. 2.

FIG. 5 shows the interior of the bottom surface 30. It can be seen that the side 34 extends around the periphery of bottom surface 30. The combination of bottom surface 30 and side 34 form a bowl-shaped arrangement. Importantly, on the interior of bottom surface 30, an abutment member 54 is attached thereto. Abutment member 54 extends upwardly from the central area centrally of the bottom surface 30. The abutment member 54 interacts with the switch of the present invention so as to activate the alarm upon the compression of top surface 28 toward the bottom surface 30. The central area 52 (as described in conjunction with FIG. 4) serves as a protective surface 56 with respect to the abutment member 54. The protective surface 54 is an upward extending ledge which protects against violent contact between the upper surface 28 and the abutment member 54. The abutment member 54 is a cylindrical member of relatively narrow diameter which extends upwardly a distance from the bottom surface 30.

Figure 6:
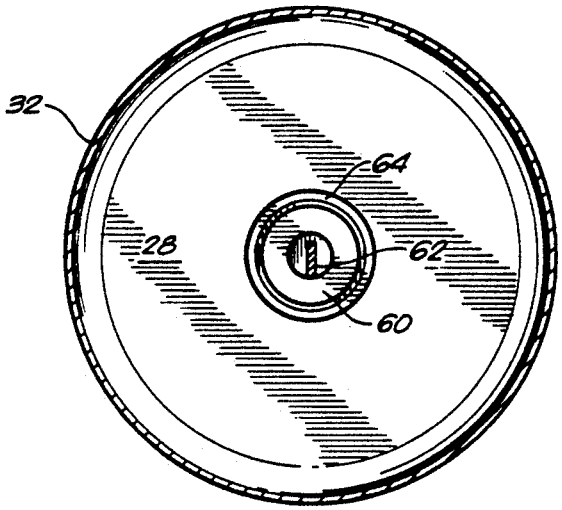
FIG. 6 is a cross-sectional view taken across lines 6—6 of FIG. 2.

FIG. 6 shows an interior view of the top surface 28. It can be seen in FIG. 6 that the side 32 is generally circular in nature and extends around the periphery of the circular top surface 28. An indented area 60 is formed on the top surface 28. Indented area 60 is formed during the molding process of the top surface 28. Indented area 60 receives the alarm mechanism, the power supply, and the switch 62 of the present invention. The details of the alarm device, the power supply, and the switch 62 are described in conjunction with FIGS. 8 and 9 herein. Importantly, a coil spring 64 extends around the indented area 60. The coil spring is a relatively large member of circular configuration having a diameter generally greater than six inches. A wide diameter coil spring was chosen as the resilient member of the present invention for several reasons. First, it is necessary for the coil spring to exert relatively strong resistive forces against the movement of the top surface 28 relative to the bottom surface 30. A large, thick and wide diameter coil spring 64 serves this purpose. Secondly, a wide diameter coil spring creates a self-levelling effect between the top surface 28 and the bottom surface 30. Since the spring 34 is centrally mounted, the spring 34 will tend to distribute any forces which are applied to an edge of the top surface 28 across the entire surface 28. As such, the present invention avoids "edge" effects which could distort the function of the present invention. In the preferred embodiment of the present invention, the coil spring 64 will compress for one and a half inches upon the application of eighteen pounds of force to the coil spring 64 (by way of the top surface 28). Although this is the preferred embodiment of the present invention, it should be noted that the quality of coil spring 34 can be adjusted for desired to limit the sounding of the alarm to the application of loads of twenty-five pounds or more, then a more rigid or lengthy coil spring 64 could be chosen. In addition, a plurality of smaller springs, a load cell, or other devices can be used to provide the resiliency of the top surface to the bottom surface. The specifics of the coil spring 64 are not intended as a limitation on the present invention.

The switch 62 is a contact switch which extends outwardly from the bottom surface 28. The contact switch 62 is movable between a first position and a second position. The first position, shown in FIG. 6, is the dormant position of the switch. When the switch is in the position illustrated in FIG. 6, no alarm is sounded. However, when sufficient forces are applied to top surface 28, then the top surface 28 will move toward the bottom surface 30. When the abutment member 54 comes into contact with the contact switch 62, the contact switch 62 will move from its first position to its second position. When the contact switch 62 is in its second position, the alarm is actuated so as to give an audio message to the user that the weight limit of the trash container has been exceeded.

Figure 7:
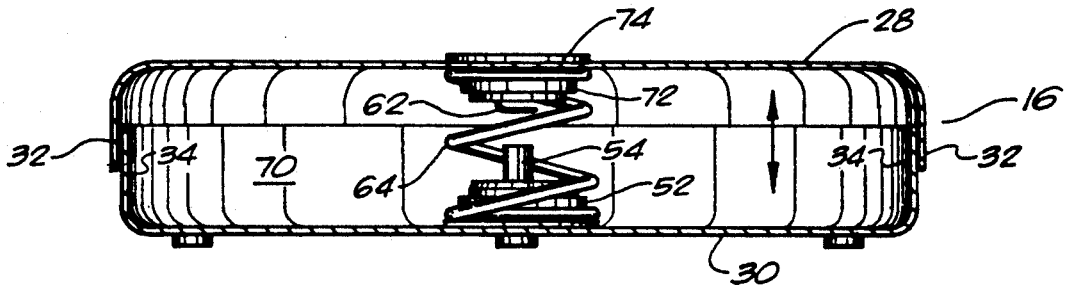
FIG. 7 is a cross-sectional view of the alarm device of the present invention as taken across line 7—7 of FIG. 3.

Referring to FIG. 7, it can be seen that the body 16 has the top surface 28 positioned in parallel relationship to the bottom surface 30. The side 32 of the top surface 28 overlaps the side 34 of bottom surface 30. It can be seen that the sides 32 and 34 are in generally close proximity. Although the interior 70 of body 16 is not "waterproof", the close relation of the side 32 with the side 34 is generally effective in resisting water intrusion into the interior 70. As such, the sides 32 and 34 have the quality of being "liquid resistant". In addition, the close proximity of the side 32 with the side 34 prevents the build up of trash or other waste material from affecting the operation of the alarm device of the present invention. As an alternative, the alarm and switch circuitry of the present invention could be coated with a liquid-resistant coating so as to provide the liquid resistance.

Figure 8:
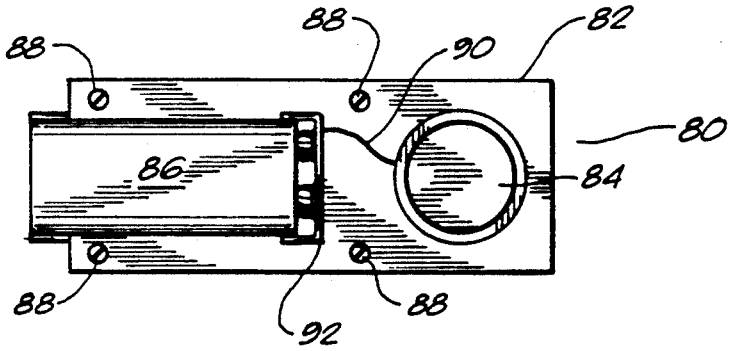
FIG. 8 is a top view showing the alarm and power supply of the present invention.
Figure 9:
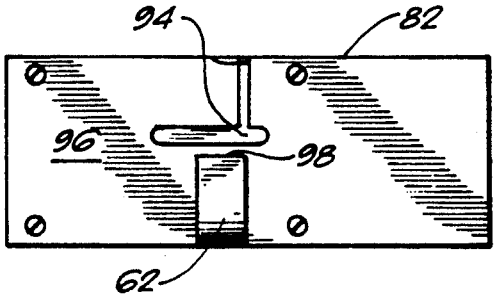
FIG. 9 is a bottom view showing the switch and alarm of the present invention.

In FIG. 7, it can be seen that the top surface 28 includes indented area 72. Indented area 72 is formed into the top surface 28 so as to receive the alarm device, the switch, and the power supply (as illustrated in FIGS. 8 and 9). The indented area 72 is generally circular in nature and acts as a receptacle for one end 74 of the coil spring 64. The contact switch 62 extends outwardly from the indented area 72 so as to be in a position to be interactive with the abutment member 54. The coil spring 64 has the quality described hereinabove. It can be seen that the coil spring 64 is centrally affixed to the top surface 28 and to the bottom surface 30. The coil spring 64 extends around the central indented area 52 of the bottom surface 30. It can be seen that the central area 52 supports the abutment member 54 thereon. The abutment member 54 is positioned so as to contact the contact switch 62 when the top surface 28 moves downwardly toward the bottom surface 30. For example, when a load of eighteen pounds or more is placed onto the top surface 28 (by filling a liner bag), then the top surface 28 will move toward bottom surface 30, thereby bringing the abutment member 54 into contact with contact switch 62. When the abutment member 54 contacts the switch 62, the audio alarm is sounded. The audio alarm serves to inform the user of the present invention that an overload condition has been created. It also serves to warn the building maintenance worker that the liner bag 14 is filled and may require extra assistance for removal. It should be noted that the present invention can be adapted so as to be responsive to various weight requirements.

FIG. 8 illustrates the alarm device 80 of the present invention. Alarm device 80 is included within the indented area 72 on the top surface 28. The alarm device 80 includes a circuit board 82, alarm mechanism 84, and power supply 86. Fasteners 88 are provided so as to secure the circuit board 82 within the indented area 72. Fasteners 80 can be screws, bolts, or other appropriate fastener mechanisms. The alarm 84 is an audio alarm which is electrically connected by line 90 to the power supply 86. In the present invention, the power supply 86 is a nine-volt battery. Battery 86 is fastened to receptacle 92 on circuit board 82. In actual use, the alarm 84 will be placed in proximity to the opening 44 on the top cover 34. When the alarm 84 is activated, a loud sound is emitted through the opening 44 so as to provide an appropriate warning to the user of the trash container 12.

FIG. 9 shows the bottom side of the circuit board 82 and, in particular, shows the operation of the contact switch 62. It can be seen that a circuit island 94 is formed on the bottom surface 96 of circuit board 82. The switch 62 is connected at one end to the circuit board 82. The other end 98 of switch 62 is in close proximity to island 94. The arrangement of FIG. 9 shows the switch 62 in its first position. The switch 62 is a generally curved flexible copper member which can be easily moved when in contact with the abutment member.

In operation, when the switch 62 comes into contact with the abutment member, the curved portion of switch 62 will compress. This causes the end 98 to move from the position illustrated in FIG. 9 to a position in contact with the island 94. Once the end 98 comes into contact with the island 94, the alarm circuit is completed. As such, power is directly supplied to the alarm 84 for the purpose of actuating the alarm device of the present invention. When the abutment member moves away from the contact switch 62, the end 98 will move back into its original position shown in FIG. 9 and the alarm will become quiet.

The present invention offers many advantages to the building maintenance worker and to building maintenance companies. Initially, the present invention provides a signal which alerts the user of a trash container to an overload condition and also alerts the building maintenance worker of the overload condition. With respect to the user of the trash container, the alarm can prove to be an annoying device which would force the user to remove some of the weight from the trash container in order to stop the alarm sound. The alarm provides a positive indication to all of the overload condition within the trash container. The present invention reduces the possibility of back injuries by the building maintenance worker. As such, the present invention also reduces the possibility of workman's compensation claims. The present invention also assists in full compliance with OSHA requirements. If the alarm is sounding, then the building maintenance worker is strongly encouraged to seek assistance when removing the liner bag from the trash container.

The present invention is adapted to received by conventional trash containers. The body of the present invention is formed so as to operate effectively in a variety of conditions. The present invention resists fouling by water intrusion or by waste material buildup. The present invention is relatively simple to manufacture and easy to use. No special training is required for the installation and/or the operation of the present invention. The bottom surface of the weight alarm device of the present invention can also be rigidly affixed to the bottom of the trash container so that it cannot be removed. The present invention can also have a wide variety of applications not directly associated with trash containers.

The audio alarm of the present invention could also be replaced by a visual alarm device. If necessary, a warning light or other indicator could extend from the alarm device to a location exterior of the trash container. As such, the audio alarm of the present invention is simply one embodiment of the present invention and is not intended as a limitation to the concept of the present invention The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. A weight alarm device for use in a trash container comprising:

a body having a top surface resiliently connected to a bottom surface, said body having a shape adapted for receipt by the trash container;

a switch means attached to said body, said switch means responsive to relative movement between said top surface and said bottom surface;

alarm means electrically connected to said switch means, said alarm means for producing a humanly perceivable signal when the relative movement between said top surface and said bottom surface exceeds a predetermined amount, said top surface having an indentation formed therein, said indentation receiving said alarm means; and a power supply electrically connected to said alarm means, said power supply for supplying power to said alarm means when said alarm means is actuated by said switch means.

2. The device of claim 1, said top surface having a first side extending downwardly therefrom, said bottom surface having a second side extending upwardly therefrom, said first side of said top surface overlapping said second side of said bottom surface.

3. The device of claim 2, said first side extending around a periphery of said top surface, said second side extending around a periphery of said bottom surface.

4. The device of claim 3, said top surface and said bottom surface having a circular shape, said first and second sides having a cylindrical configuration, said second side slidably received within said first side.

5. The device of claim 1, said bottom surface having a plurality of feet formed thereon, said feet extending below said bottom surface, said feet abutting a bottom surface of the container.

6. The device of claim 1, said alarm means comprising an audio alarm, said power supply being a battery.

7. The device of claim 1, said body having a coil spring interposed between said top surface and said bottom surface, said coil spring providing a desired resistance to the relative movement between said top surface and said bottom surface.

8. The device of claim 7, said body having a single coil spring therein, said coil spring having one end affixed centrally to said bottom surface, said coil spring having an opposite end affixed centrally to said top surface, said coil spring having a diameter of greater than six inches.

9. The device of claim 7, said switch means comprising:

a contact switch affixed to said top surface, said contact switch movable between a first position and a second position, said second position for actuating said alarm means; and an abutment member affixed to said bottom surface, said abutment member aligned with said contact switch such that a relative movement of said top surface with respect to said bottom surface causes said abutment member to contact said contact switch, said abutment member for causing said contact switch to move between said first position and said second position.

10. The device of claim 9, said abutment member positioned generally centrally with respect to said bottom surface, said contact switch positioned generally centrally with respect to said top surface, said abutment member and said contact switch arranged within said coil spring.

11. An alarm device comprising:

a trash container;

a liner bag extending within said trash container;

a body positioned within said trash container and supported by a bottom of said trash container, said body having a top surface resiliently connected to a bottom surface, said liner bag contacting said top surface;

switch means attached to said body, said switch means responsive to relative movement between said top surface and said bottom surface; and alarm means connected to said switch means, said alarm means for producing a humanly perceivable signal when the relative movement between said top surface and said bottom surface exceeds a predetermined amount.

12. The device of claim 11, said top surface having a first side extending downwardly therefrom, said bottom surface having a second side extending upwardly therefrom, said first side of said top surface overlapping said second side of said bottom surface.

13. The device of claim 12, said top surface and said bottom surface having a generally circular shape, said first and second sides having a cylindrical configuration, said second side slidably received within said first side.

14. The device of claim 11, said body having a diameter approximately equal to an interior diameter of said trash container, said liner bag receiving material therein, said top surface moving downwardly relative to a weight of material in said liner bag.

15. The device of claim 11, said body being generally liquid resistant between said top and bottom surfaces so as to resist liquid intrusion into said switch means and to said alarm means.

16. The device of claim 11, said body having a coil spring interposed between said top surface and said bottom surface, said coil spring providing a desired resistance to the relative movement between said top surface and said bottom surface.

17. The device of claim 16, said switch means comprising:

a contact switch affixed to said top surface, said contact switch movable between a first position and a second position, said second position for actuating said alarm means; and an abutment member affixed to said bottom surface, said abutment member aligned with said contact switch such that a relative movement of said top surface beyond a predetermined amount causes said abutment member to contact said contact switch, said abutment member causing said contact switch to move from said first position to said second position.

18. The device of claim 17, said coil spring having one end affixed centrally to said bottom surface, said coil spring having another end affixed centrally to said top surface, said abutment member and said contact switch positioned generally centrally within said coil spring.

* * * * *